United States Patent [19]

Nilsson, deceased et al.

[11] Patent Number: 4,485,861

[45] Date of Patent: Dec. 4, 1984

[54] METHOD AND APPARATUS FOR PROCESSING LOGS HAVING A NONUNIFORM PROFILE

[75] Inventors: Philip Nilsson, deceased, late of Söderhamm, by Margaretha Nilsson, legal representative; Urban Eklund, Söderhamm; Jan-Erik Gasslander, Garpenberg, all of Sweden

[73] Assignee: Kockums Industri AB, Soderham, Sweden

[21] Appl. No.: 365,547

[22] Filed: Apr. 5, 1982

[51] Int. Cl.[3] ..... B27B 1/00; B27L 11/00

[52] U.S. Cl. ..... 144/357; 83/71; 83/364; 83/367; 83/368; 144/39

[58] Field of Search ..... 144/39, 356, 357; 83/71, 364, 367, 368

[56] References Cited

U.S. PATENT DOCUMENTS

| | | | |
|---|---|---|---|
| 3,692,074 | 9/1972 | Nilsson | 144/39 |
| 3,960,041 | 6/1976 | Warren | 144/39 |
| 3,971,423 | 7/1976 | Miller | 144/176 |
| 4,316,491 | 2/1982 | Kearns | 144/39 |

FOREIGN PATENT DOCUMENTS

| | | | |
|---|---|---|---|
| 882743 | 2/1979 | U.S.S.R. | 144/39 |

*Primary Examiner*—James M. Meister

*Attorney, Agent, or Firm*—Seed and Berry

[57] ABSTRACT

A flat reducing and sawing installation for processing tapering logs includes a reducing section and a sawing section through which logs pass in sequence. The reducing section includes two reducing disks which can each be moved outwards by respective positioning devices. The sawing section includes at least two laterally movable saw blades. The position of the reducing disks is controlled by an electronic evaluation and control unit on the basis of profile data fed in about the log, which indicates that at least one of the disks is about to grind sufficient material from one side of the log to form a plank of a minimum acceptable thickness, length and width. Under these circumstances, the control unit moves the appropriate reducing disk outwardly by at least the minimum acceptable thickness to allow the outermost saw of the sawing section to saw off the resulting plank.

18 Claims, 7 Drawing Figures t1
s1
s2
t2
14'
15'
40
18'
19'
50
12'
11'
12
11
CL y1
y2
10
20a
21a
22a
22b
17a
16a
CS
h1
h2
16
20
22
21
17
x1
x2

METHOD AND APPARATUS FOR PROCESSING LOGS HAVING A NONUNIFORM PROFILE

DESCRIPTION

1. Technical Field

The invention relates to the timber processing field and, more particularly, to a method and apparatus for automatically adjusting timber reducing and sawing equipment to maximize the yield of acceptably sized boards from the timber and minimize the saw mill waste.

2. Background Art

The handling of planks in a sawmill is highly labor-intensive. Imperfect planks, such as planks with pointed ends or planks with "waists" (imperfect areas in the middle regions of the flat surface of a plank, known as the "clear area"), give rise to particular problems, including interruptions in the operation of the sawmill known as "stoppages." Stoppages in the conveyor installations of a sawmill are taken to cause losses in the region of five to ten percent of the working time, and many such stoppages are caused by planks with pointed ends or waists getting stuck at an angle on conveyors and in feeders. It is therefore extremely important for such faulty planks to be removed from the production process as quickly as possible and scrapped, such as by chopping them up into chips. However, since chips are worth considerably less than processed timber, it is also important that timber be chipped only if processed timber of adequate size cannot be obtained.

There are two principal reasons why relatively large quantities of planks must be scrapped. The first reason arises from the inherent inability of a single saw spacing to efficiently process timber of varying sizes. Incoming logs are first sorted according to diameter into what are known as "centimeter classes." All logs having a diameter falling within certain limits are included in respective centimeter classes. The lateral positions of the saw blades are matched to each class so that when logs having a diameter close to the lower limit are processed, a large number of misshapen pieces of timber are necessarily produced. The second reason for scrapping planks results from nonuniformities and imperfections in the logs, such as crookedness, large knots, ovality, etc.

The introduction of the "reducing saw" method has brought about a distinct improvement in sawmill technique. In the "reducing saw" method, the sides of a log are face milled by a chipper before the log reaches the band saws. As a result, the outer parts, which would otherwise form what are known as "waste slabs," are immediately reduced to chips. Despite this, a number of problems remain unsolved since fifty to seventy percent of the outer planks produced in the saw after face milling are improperly shaped. As a result, it is necessary to sort the outer planks to reject the improperly shaped planks; and this sorting requires additional labor.

It has already been proposed in German patent application No. P 29 47 993.4 published in print as Offenlegunschrift 2,947,993 on July 23, 1981, and in the corresponding Swedish patent application No. 8008297 that, on processing logs in a reducing machine, account should be taken of the conical shape of the logs, tapering from the root end to the top end. Accordingly, the width of the log is continuously sensed during feeding-in by two sensing probes which control hydraulic or pneumatic positioning mechanisms for cutting tools at opposite sides of the log. When the lateral amount removed by the cutting tools becomes so great than an extra side plank can be obtained on either side of the log, the distance between the cutting tools is increased. As a result, timber that would otherwise have been converted into less valuable chips forms an additional side plank on either side of the reduced log. However, not all extra side planks obtained in this way are usable, since some of them have to be scrapped, and then this procedure is more complex and costly than if the corresponding volume of timber had been chipped from the outset by the cutting tools. For a plank to be accepted, it is not sufficient for it to have the prescribed minimum thickness; it must also have this minimum thickness over an area having a specified minimum length and minimum width. Thus three kinds of product are produced from the side parts of the log, namely, chips, acceptable side planks, and inferior side planks, which must be sorted out, removed from the production line and separately chopped into chips in some machine other than the reducer.

DISCLOSURE OF THE INVENTION

The principal object of this invention is to process timber so that only two kinds of product are obtained from the side parts of the logs, namely, chips and acceptable extra side planks.

It is another object of the invention to produce on one side of the log acceptable extra side planks of maximum possible length, regardless of whether such planks can be produced on the opposite side of the log. This makes it unneccessary to subsequently sort out the unacceptable extra side planks and then chop the unacceptable extra side planks into chips in a separate operation. The highest possible yield is also obtained since the extra plank obtained on each side of the log has the maximum possible length.

These and other objects of the invention are accomplished by feeding the narrow top end of a log longitudinally through a reducing section having a pair of axially movable reducing disks on opposite sides of the log. The log is then fed into a sawing section having at least two laterally adjustable saw blades. The profile of the log is measured ahead of the reducing section to determine the side contour of the log, and these measurements are applied to a control unit, preferably in the form of a computer. The control unit calculates the available plank thickness, length and width of the portion on each side of a log that would be removed by the reducing disc on that side remaining in its current position. In the event that the available plank thickness, length and width on any side of the log all exceed the minimum acceptable plank thickness, length and width, respectively, the reducing disk on that side of the log is moved away from the center line by a distance at least equal to the minimum acceptable plank thickness plus the width of one saw cut. The outer saw blade in the sawing section then cuts off the plank made available by the outward movement of the disk. The reducing disks may also, additionally, be moved simultaneously in the same direction when treating curved logs in the said manner.

BEST MODE FOR CARRYING OUT THE INVENTION

Figure 1:
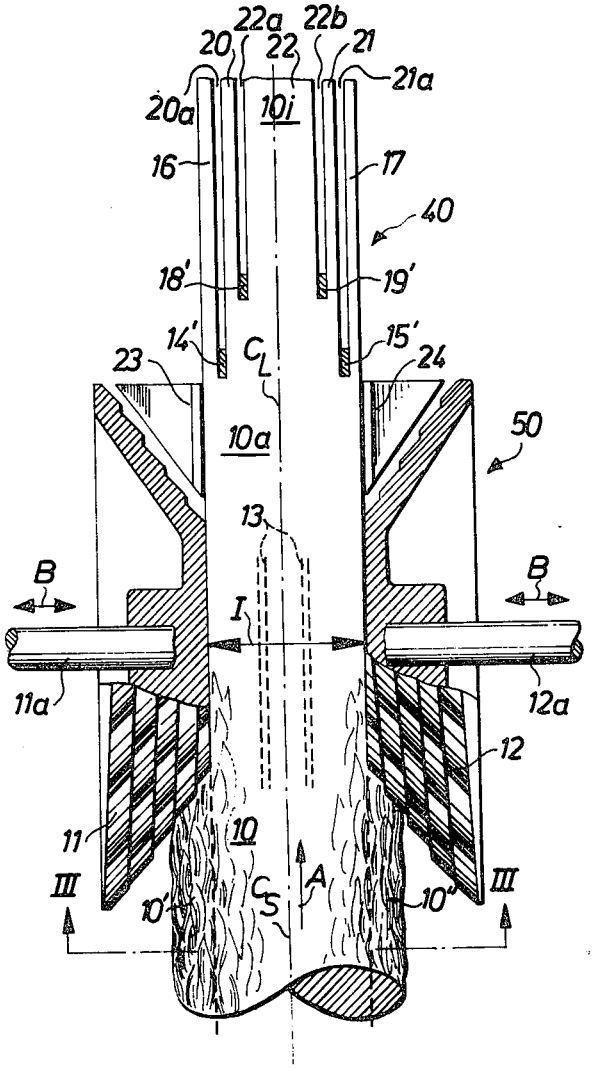
FIG. 1 is a top plan view of a part of a conventional reducing sawing machine in which a log is being processed.

FIG. 1 shows a reducing and sawing machine as described in U.S. Pat. No. 3,692,074. The machine includes a reducing section 50 and a sawing section 40 with a common center line $C_L$. A log 10 with a center line $C_S$ is to be flat-reduced on both sides and then cut into several parts. The log 10 is carried on a conveyor 13 in the direction of arrow A between two conventional chopping or reducing disks 11,12 which mill off and chop into chips the extreme outer parts 10',10'' of the log, which would otherwise become slabs which would have to be separated and chopped.

Each reducing disk 11,12 is mounted on a driveshaft **11*a*,12*a*** driven by an electric motor (not shown).

Conventionally, reducing disks 11,12 are adjustable in the longitudinal direction B of their driveshafts **11*a*,12*a* only to the purpose of accommodating logs of different diameters. The distance I between them remains unchanged during the entire reducing process. Guide devices 23,24 having flat, inwardly facing guide surfaces are positioned between reducing disks 11,12 and sawing installation 40. The guide devices 23,24** can also be moved away from and towards each other.

Figure 5:
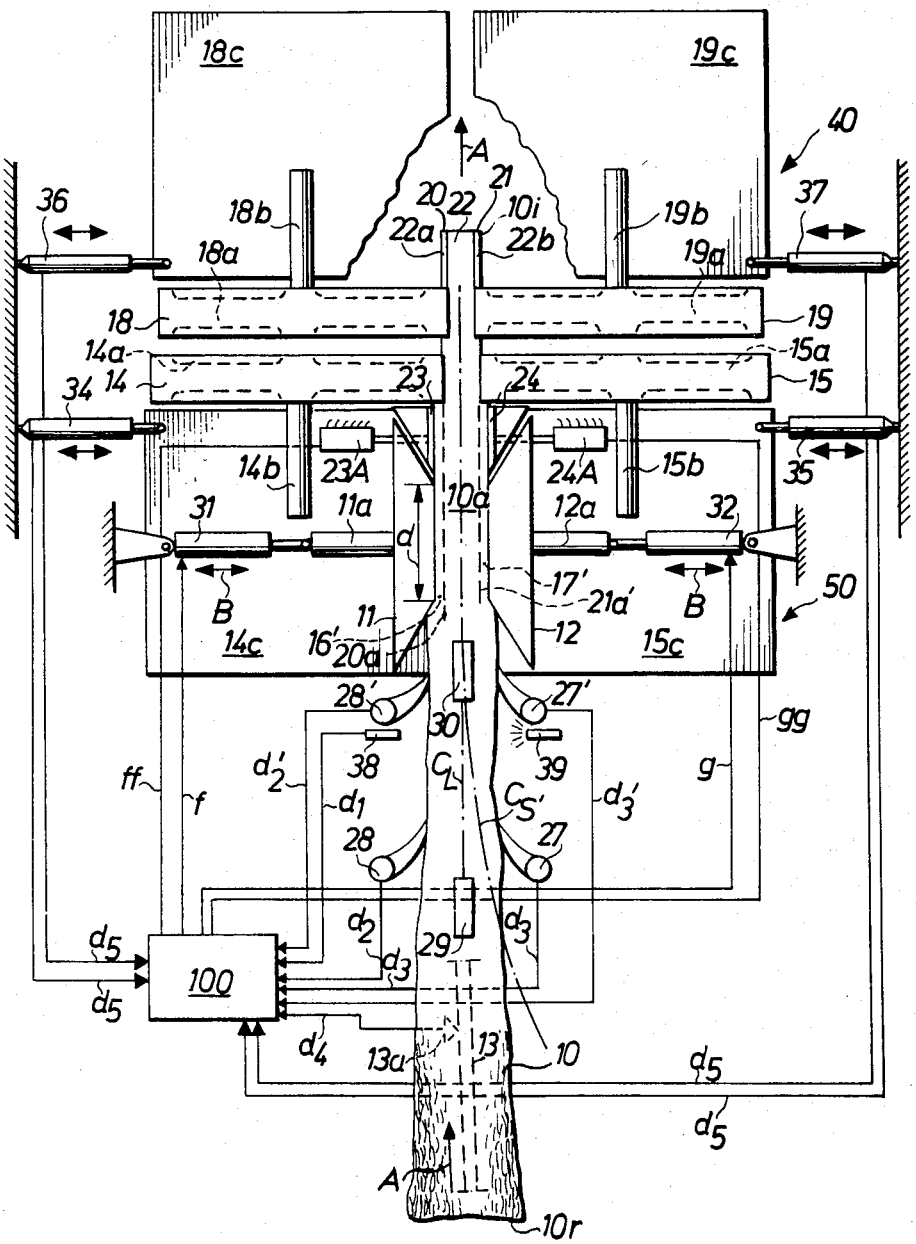
FIG. 5 is a top plan view of the inventive sawing apparatus.

After leaving reducing disks 11,12 and passing guide devices 23,24 the leading end **10*i* of the log, reduced to a block 10*a* with width I, enters the sawing section 40. In the example shown, the sawing section 40 is a bandsaw installation made up of four conventional bandsaw machines, of which FIG. 5 shows sawbands 14,15,18,19 running over rollers 14*a*,15*a*,18*a*,19*a*, each arranged on its own shaft 14*b*,15*b*,18*b*,19*b*. However, FIG. 1 shows only the inner parts 14',15',18',19'** of these sawbands.

In sawing installation 40, block **10*a* is cut into a center block 22, two inner planks 20,21, and two outer planks 16,17, separated from each other by sawcuts 20*a*,21*a*, 22*a*,22*b***.

Figures 2A, 2B:
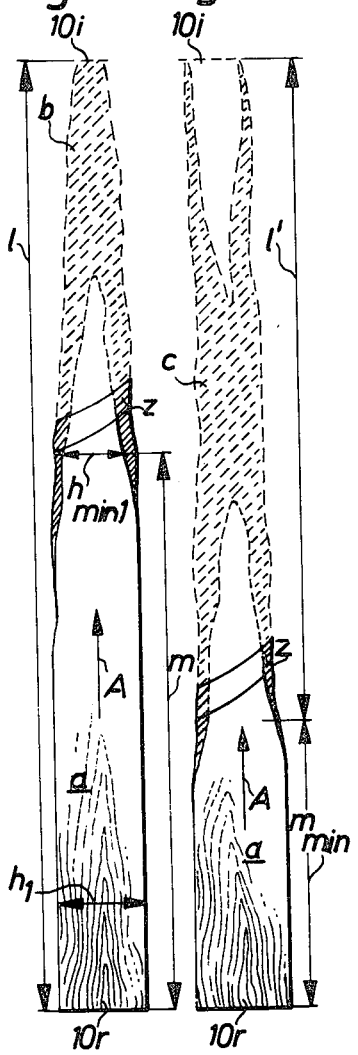
FIGS. 2*a* and 2*b* are plan views of two typical outer planks with faults that can be obtained in the machine of FIG. 1.

After this process, the outer planks may be as shown in FIG. 2*a* or 2*b*, where the broken contour lines show the parts which, according to the present invention, will be milled off; whereas in a conventional reducing and sawing installation, they would remain. At the wider root end **10*r* of the log, the diameter is generally large enough to produce a satisfactory outer plank. But the region toward the top end 10*i*** often has an area "b" (FIG. 2*a*) where the prescribed minimum clear area width $h_{min}$ is not achieved, or a reduced diameter area "c" (FIG. 2*b*) known as a "waist." According to the present invention, the sides of the log in these areas are milled off and, when a portion of the log having a large enough diameter reaches the disks 11,12, one or both disks 11, 12 are stepped out. As a result, a step or shoulder z is formed as the width I abruptly increases, thereby forming an area "a" from which an extra plank can be produced if there remains, of the entire length l of the log, a satisfactory piece with at least a predetermined minimum length $m_{min}$. The present invention thus achieves the object of producing only satisfactory outer planks, while parts of logs such as "b," "c," which would result in defective outer planks, are chopped before they leave the reducing and sawing installation.

Figure 3:
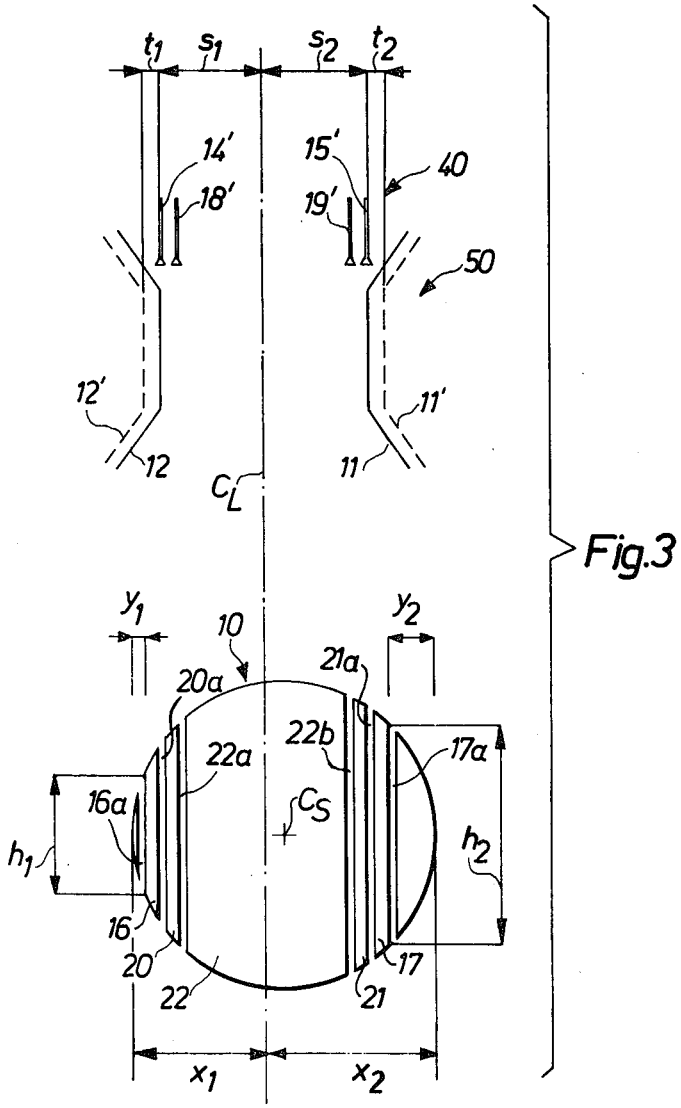
FIG. 3 is a cross-section of a log taken along the line III—III of FIG. 1 and a schematically drawn reducing sawing machine, both marked with the geometrical variables that are of importance for the present invention.

FIG. 3 is a cross-sectional view through log 10 along the plane III—III in FIG. 1. For clarity, the cross-section has been tilted 90° so that it lies in the plane of the drawing, and all prospective cut lines are drawn on the cross-section. The reducing and sawing machine is shown in FIG. 3 in a slightly modified version of the machine of FIG. 1 since the sawing section 40 is close to or inside the reducing section 50, thus reducing the overall length of the installation and making it possible to eliminate guide devices 23,24 (FIG. 1).

The distances from the center line $C_L$ of the processing machine 40,50 to the two outermost parts of the log are $x_1$ and $x_2$, and are measured by conventional profile detection devices. Generally, the center line $C_S$ of the log does not coincide exactly with the center line $C_L$ of the machine. The width of the clear area is $h_1$ or $h_2$, while $s_1$ and $s_2$ are distances from the center line $C_L$ to the inside edge of the outermost saw blades 14',15'. The distances $s_1$,$s_2$ are automatically determined by the positioning of the saw blades. The values $t_1$ and $t_2$ are thicknesses of outer planks 16,17, including intervening sawcuts **20*a*,21*a*. $y_1$ and $y_2$ are the thickness of slabs 10',10'' (FIG. 1) which are milled off by reducing disks 11,12 along plane faces 16*a*, 17*a*** parallel with said saw cuts. As FIG. 3 shows, the relationships between the variables mentioned above are:

$$x_1 = y_1 + t_1 + s_1 \quad (1a)$$

$$x_2 = y_2 = t_2 + s_2 \quad (1b)$$

FIG. 5 shows schematically an embodiment of the arrangement for carrying out the method according to the invention. The arrangement includes a conveyor 13 on which a log 10 is advanced, being held in position thereon by retaining rollers 29,30. Log 10 is detected by two detecting devices located in front of the reducing discs 11 and 12 of the arrangement. These detecting devices constitute the previously mentioned conventional profile measuring devices, and each consists of a pair of shoes 27,28 and 27',28'. Their purpose is to determine the external contours of log 10 longitudinally, and the position of the contour lines relative to a reference line, such as the center line $C_L$. In principle, one of the two detection devices shown is sufficient and any other known mechanical or optical detection arrangement can, of course, be used.

Output signals from the detectors go via wires $d_2$,$d_3$ and $d_2'$,$d_3'$ to an electronic control unit 100, which is preferably a conventional computer operating in accordance with a program of instructions.

Arranged between position detectors 27,28 and reduci0g disks 11,12 is an optical barrier made up of a light-sensitive element 38 and a light source 39, and which, via wire $d_1$, supplies electronic control unit 100 with a signal that indicates the passage of the leading end **10*i*** of each log. At a known feed speed, the longitudinal position of the log can thus be calculated as a function of time.

The electronic control unit 100 is also supplied with a sequence of signals from a transmitter 13*a* corresponding to the motion of conveyor 13. These signals allow the control unit 100 to determine the longitudinal position of the log. On the basis of the data fed in via wires $d_1$–$d_4$, the profile of log 10 can be stored in electronic control unit 100 in a known manner. Preferably, the profile of the log 10 is sensed at a sufficient distance before reducing disks 11,12 to detect a waist "c" at the center of the log. For a log length l of 4 m, for example, shoes 27,28 should therefore be at least 2 m before reducing disks 11,12.

The reducing disks, with their shafts 11*a*,12*a*, are mounted in bearings (not shown) and driven in rotation in a conventional manner. The reducing disks can be moved away from and towards each other each by its own positioning device, such as a double-acting cylinder/piston assembly 31,32. The guide devices 23,24 between reducing disks 11,12 and saw blades 14,15 must, of course, be capable of displacement in the same way as the reducing disks. This can be done either by coupling them to the positioning devices 31,32 of the reducing disks or by coupling them to their own positioning devices 23A,24A, which are controlled by the electronic control unit 100 via separate wires ff and gg. Devices 23A and 24A can also be double-acting cylinder/piston assemblies. In this case, electronic control unit 100 is programmed so that guide plates 23,24 move in the same direction and to the same extent as the reducing disks, but only after a predetermined delay. In this way, log 10 is also guided by these guide devices during the time interval before the shoulder z (FIG. 2) has time to reach the upstream edges of the guide plates 23,24. Said delay may be applied only to the outward movement, or also to the inward movement, e.g., when the guides have to accommodate the rear end of one log and the disks the narrower leading end of the next log.

The electronic control unit can also be programmed so that, in the event that the log is curved, as shown by the center line $C_S'$, it can move both reducing disks 11,12 and guide plates 23,24 simultaneously by identical distances in the same direction so that they follow the curvature of the log. This coordinated displacement is superimposed, i.e. combined with the stepping-out of one or other of the reducing discs due to the increasing diameter of the log, as explained above. As a result of this, curved logs can also be efficiently processed according to the present invention. In the example according to FIG. 5, both reducing disks 11, 12 and guide plates 23,24 would be displaced together to the right by an amount corresponding to the deviation between center lines $C_L$ and $C_S'$.

The entire detection arrangement, regardless of the number of places at which detection takes place along the length of the log, can also be situated at some place other than immediately adjacent to the actual timber processing machine, and can be connected to electronic control unit 100 by wires of appropriate length instead of the relatively short wires $d_2$, $d_3$, etc., shown in FIG. 5.

Shape detection, i.e. profile measurement of the logs can take place not only without direct connection with the processing machine 40, 50 in respect of space, but also without direct connection, in respect of time, with the actual processing of a given log into this machine, the results of such measurements being fed in and stored in electronic unit 100, as already stated. Optical barrier 38, 39, or any other presence detecting means, generates a signal when the leading end 10*i* of a log passes by. This signal triggers the output of actuating signals from unit 100 to the positioning means 31, 32 and also 23A, 24A if and when the measurements and the calculations in the unit 100 indicate that the one or the other chipping disk shall be moved. Due respect is of course taken to the time interval needed for the log to move from the presence detecting means to the processing machine. This interval is readily calculated from the known spacement of the presence detecting means and processing machine and the feed speed of the conveyor 13, detected by transmitter 13*a*.

After reducing section 50 of the installation, a sawing section 40 is arranged. The sawing section 40 includes saw blades 14,15,18,19 each passing over its upper deflection roller 14*a*,15*a*,18*a*,19*a* mounted on shafts 14*b*, 15*b*,18*b*,19*b*. The sawing section 40 also includes additional elements which are not illustrated for purposes of clarity since such sawing mechanisms are conventional. The shafts 14*b*,15*b*,18*b*,19*b* are mounted on respective baseplates 14*c*, 15*c*,18*c*,19*c* that can be moved towards and away from the center line $C_L$. The motion of the baseplates is achieved with the aid of positioning devices, for example, doubleacting hydraulic cylinder/-piston assemblies 34–37, which are fixed at one end and connected to the respective baseplates at the other end.

Thus, by means of positioning devices 34–37, the position of each saw blade is individually adjustable relative to the center line $C_L$. Signals indicative of the position of the positioning devices 34–37 may be input to electronic control unit 100 via wires such as $d_5$.

Positioning devices 31,32 for reducing disks 11,12 are connected via wires f,g to electronic control unit 100 to receive control signals generated in this unit.

FIG. 5 shows the situation shortly after the instant at which reducing disks 11,12 have been moved out so that extra outer planks 16',17' are obtained, as indicated by dashed lines 20*a*',21*a*', which represent the sawcuts that will be made by saw blades 14,15.

It should be noted that these saw blades 14,15 may be adjusted so that they slide along the outer, flat, reduced faces of planks 20, 21 whereby these faces are given the texture of a sawn surface along their entire length.

The thickness of the extra outer plank can, of course, be selected from suitable standardized plank thicknesses with regard both to the dimension $x_1$ (FIG. 3) of the log half and to the remaining length m of the log. It is thus possible to obtain a plank with a smaller thickness than the thickness that has priority at the time, if it is seen that other limits for the plank will be exceeded with the thickness that has priority at the time.

With the aid of FIG. 3, the following equations can be set up, giving values of $h_1$ and $h_2$:

$$(0.5\,h_1)^2 = (x_1 + x_2 - y_1)\cdot y_1 \tag{3a}$$

$$y_1 = x_1 - s_1 - t_1 \tag{4a}$$

which gives:

$$h_1 = 2\sqrt{(x_2 + s_1 + t_1)(x_1 - s_1 - t_1)} \tag{5a}$$

$$(0.5\,h_1)^2 = (x_1 + x_2 - y_2)\cdot y_2 \tag{3b}$$

$$y_2 = x_2 - s_2 - t_2 \tag{4a}$$

which gives:

-continued $$h_2 = 2\sqrt{(x_1 + s_2 + t_2)(x_2 - s_2 - t_2)} \quad (5b)$$

$$h_1 \geqq h_{min1} \quad (6a)$$

$$h_2 \geqq h_{min2} \quad (6b)$$

$$m \geqq m_{min} \quad (7)$$

dimension m being given by FIG. 2*b*, and the value $m_{min}$ being the predetermined (programmed) minimum value of this dimension.

Reducing disks 11,12 are stepped out when conditions (*6a*), (*6b*) and (7) are all met.

Figure 4:
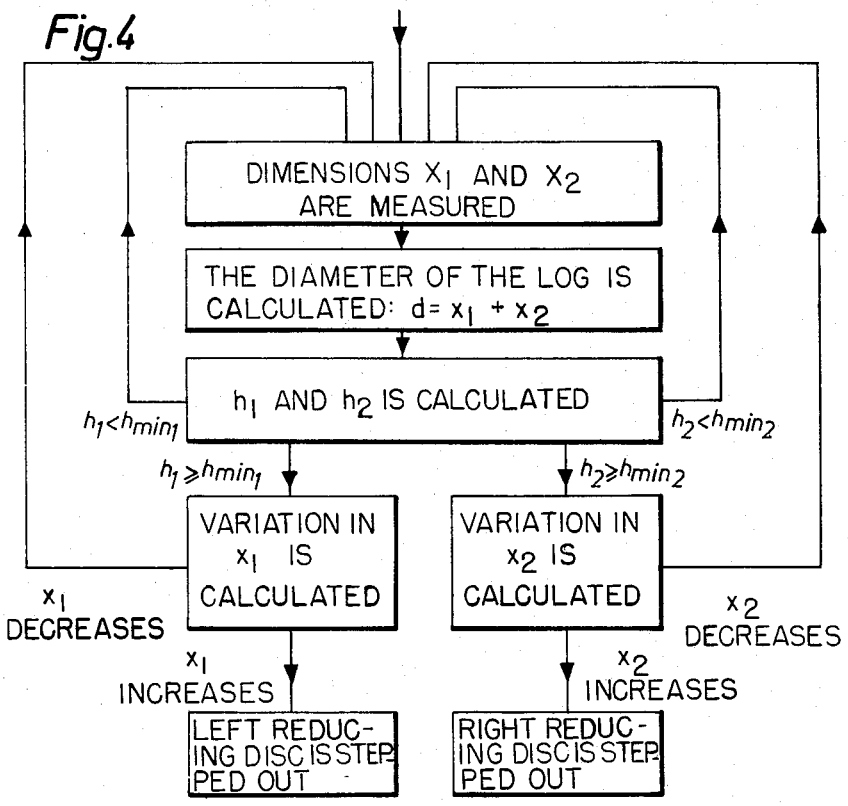
FIG. 4 is a flowchart of the process for controlling the operation of the inventive sawing apparatus.

The above formulae are processed by the control unit 100 according to the flow chart of FIG. 4. The values $x_1$ and $x_2$ are first measured by the profile measuring devices using shoes 27,28, and the diameter of the log is then calculated by summing these two measurements. The variables $h_1$ and $h_2$ are then calculated according to formulae 5a and 5b. The variables $h_1$ and $h_2$ are then compared to respective values $h_{min1}$ and $h_{min2}$, which have been manually entered into the control unit 100. The values $h_{min1}$ and $h_{min2}$ represent the lowest permissible clear area width (generally $h_{min1}=h_{min2}$ When one of the dimensions $x_1$, $x_2$ exceeds a certain value, the flat, reduced outer face of the log, which face constitutes also the outer, flat face of an outer plank, will be narrower than required to achieve a predetermined minimum dimension $h_{min1}$ for the clear area width (for example, 75 mm). Under these circumstances, reducing disk 12 remains in its current position so that the timber that would otherwise make an unacceptable outer plank is instead reduced off by the disk 12. As soon as the distance of the reducing disk from the center line $C_L$ falls below the critical value (dimensions $x_1$,$x_2$ increase in step with the forward feeding of the log since the diameter of the log ($x_1+x_2$) increases as the root end is approached) and at the same time, the remaining, unreduced log length m (according to FIG. 2*a*) corresponds at least to the minium dimension $m_{min}$ (FIG. 2*b*) set and fed into the electronic control unit, reducing disk 12 is stepped out, preferably after a given programmed delay, and an extra outer plank is obtained. The same thing applies as regards the values $t_2$, $s_2$, $h_{min2}$ and reducing disk 12. The calculated value $h_1$, $h_2$ is compared to $h_{min1}$, $h_{min2}$, and if h is greater than $h_{min}$, a variation in the dimension $x_1$,$x_2$ is calculated. If the dimension $x_1$, $x_2$ is to increase, an appropriate signal is sent to the positioning devices 31,32 to step out the disks 11,12.

The remaining log length is obtained in the electronic unit by a subtraction operation $$m = l - l' \quad (2)$$

where l, l' and m stand for the variables shown in FIG. 2*b*, of which l has been fed into the electronic control unit 100 before the work shift and l' has been calculated with the aid of the signals fed in via conductors $d_1$,$d_4$ (FIG. 3), partly for the passage of the top end past the optical barrier 38,39, partly for the speed of motion of the conveyor 13.

If there is a waist c (FIG. 2*b*) at a shorter distance from root end 10*r* than the dimension $m_{min}$, the reducing disk remains at its inner position all the time. The following three cases may occur, for example:

(A) At a certain length l' from the top end 10*i*, the reduced block 10*a* will possess sufficient clear area width $h_1$; and this is maintained at least over the minimum length $m_{min}$.

(B) The width of the clear area is sufficient at the top end 10*i* but not at the middle region closer to the root end, where the minimum dimension $h_{min1}$ is not achieved.

(C) The clear area width is sufficient over the entire length l, but there is a waist c closer to the root end 10*r* than minimum length $m_{min}$.

In all three cases, the reducing disks 11,12 are in their inner position when log 10 enters the reducing installation.

In cases (B) and (C), they remain there during the entire reducing operation, whereas in case (A), they move out at a given instant. It should be noted that the profile of the log is determined separately on each side of the reference line $C_L$. If this profile is asymmetrical, and this is especially the case for curved logs, a reducing disk may move out on one side only, or the disks may move out at different times on each side.

Figure 6:
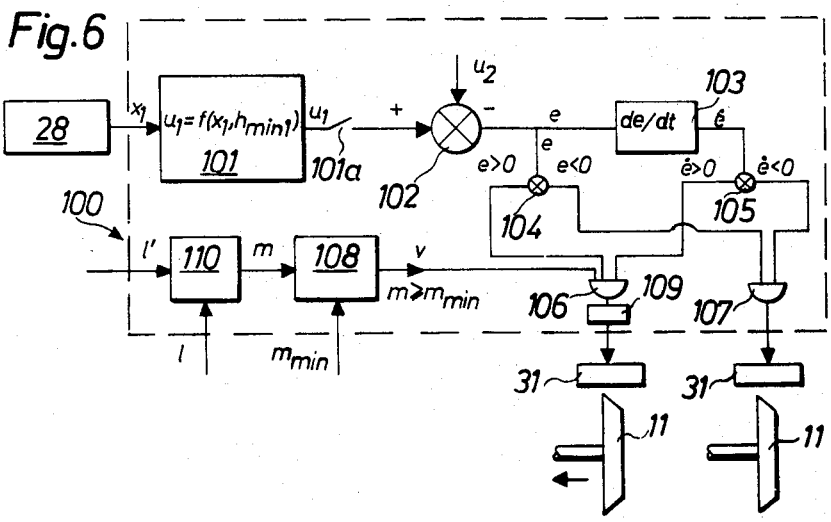
FIG. 6 is a schematic diagram of the electronic unit in the sawing apparatus of FIG. 5.

Once the available width h has been found to be larger than the minimum acceptable width $h_{min}$, as explained above with reference to FIG. 4, the remaining calculations and comparison operations are performed by the control unit, as shown in the diagram in FIG. 6. For clarity, only processing of the signals for setting the left reducing disk 11 in FIG. 5 is shown. The same diagram obviously applies also to processing signals for the right reducing disk 12.

The signals $x_1$ and $x_2$ from detectors 28 and 27 respectively are fed into a processor 101, which gives an output signal representing the value $h_1$ (calculated according to formula 5*a*) which is the available plank width for a given plank thickness $t_1$ and a given value of the distance $s_1$ (FIG. 3).

Via a switch 101*a*, the signal $h_1$ is applied to a first comparator 102, to which a value $h_{min1}$ is also applied, indicative of the proposed minimum plank width. Thus, $h_1$ is the width of the plank that would be formed by the left reducing disk in position 12'. From comparator 102, a signal 3, corresponding to the difference between $h_1$ and $h_{min1}$, is applied to a differentiator 103. The signal e is fed in parallel to a second comparator 104, and its derivative ė is fed to a third comparator 105. Depending on the comparison result obtained, the result is fed from both comparators 104 and 105 either to an AND-gate 106 or is disregarded. A signal v is also fed to AND-gate 106. The output of gate 106 is connected to the positioning device 31 of reducing disk 11 (FIG. 5).

The second comparator 104 thus determines whether $e \geqq 0$; and when this is the case, a signal goes to AND-gate 106. The condition $e \geqq 0$ will be present whenever the log has a diameter that is sufficiently large to produce a plank that is thicker than the plank that would be produced by the saw blade if it were left in its present position. The derivative ė of e shows whether e is increasing or decreasing, as indicated by the symbols + and − alongside the first comparator 102. If $\dot{e} \geqq 0$, e is increasing and the signal goes to AND-gate 106; otherwise it is disregarded. The comparison is performed in the third comparator 105. When both $e \geqq 0$ and $\dot{e} \geqq 0$, and AND-gate 106 has a signal at both corresponding inputs as well as on a third input, AND-gate 106 causes reducing disk 11 to move out. The third input to AND-gate 106 is generated by a fourth comparator 108, which determines whether the length of a possible extra outer plank is equal to or exceeds the set minimum length ($m \geqq m_{min}$). When this is the case, the signal v goes to the third input of AND-gate 106.

The value m is determined in a subtraction unit 110 in which the aforementioned counting operation (2) is performed. If desired, electronic control unit 100 can also be equipped with a delay unit 109 after three-input AND-gate 106.

Obviously, the signal from position detector 27 for setting the reducing disk 12 is processed in an analog manner. Electronic control unit 110 can also be of simpler design. For example, an algorithm that takes into account the distance from the root end 10*r* of the log may be used to select an appropriate thickness and width for the plank 16,17 taken off between reducing disks 11,12 and outermost saw blade 14',15'.

It is evident that the invention can also be used in a reducing sawing installation with only two saw blades, where the choice is between obtaining only a center block 22 or a center block 22 plus one or two outer planks 20, 21, possibly of shorter length.

Depending on the length and taper of the log, the stepping-out of one or both reducing disks can be produced, and the need to sort them out and chop them in a separate chopping installation is thus eliminated. Furthermore, an even better raw material yield is achieved since an extra side plank is produced as soon as possible on at least one side of the log.

We claim:

1. A method of processing logs having a diameter which generally increases toward their root end and which are fed with their narrower, top end through a timber processing installation having a flat reducing section including a pair of reducing disks which are independently adjustable toward or away from a center line, and a sawing section including at least two laterally adjustable saw blades positioned on opposite sides of said center line, said saw blades being adapted to form at least one plank on each side of said logs after they have been processed by said reducing section, said method comprising:

measuring the profile of said log with respect to a reference line;

determining a minimum acceptable plank thickness, length and width;

calculating from said profile measurements the available plank thickness, length and width corresponding to the thickness, length and width, respectively, of the portions of said log which would be removed by said reducing disk in their current positions;

comparing said available plank thickness, length and width with said minimum acceptable thickness, length and width, respectively, for each side of said log;

generating an actuating signal for removing a disk away from said center line by at least said minimum acceptable plank thickness when said available plank thickness, length and width on the same side of said log as the reducing disk to be moved is larger than said minimum acceptable plank thickness, length and width, respectively; and releasing said signal when the respective log passes through said flat reducing section, thereby maximizing the yield from said log and minimizing the saw mill waste.

2. The method of claim 1 wherein the profiles of said logs are measured in at least two different positions along their length in order to calculate said available plank thickness, length and width.

3. The method of claim 1 wherein a laterally displaceable guide for said logs is positioned between said reducing section and said sawing section and wherein said method further includes the step of adjusting the position of said guide in accordance with the position of the adjacent reducing disk.

4. The method of claim 3 wherein said guide is moved to said adjusted position a predetermined period after the position of said adjacent reducing disk has been changed, said predetermined period corresponding, when the said reducing disk is moved outward or stepped out, to the time required for said log to move longitudinally from said reducing disk to said guide, and when said reducing disk is moved inward or stepped in to accomodate the top end of a new log, to the time necessary for the root end of the preceding log to leave the guide zone.

5. The method of claim 1, further including the steps of measuring the curvature of said log before said log enters said reducing section and simultaneously moving said reducing disks in the same direction and to the same extent in accordance with the measured curvature of said log so that said reducing disks follow the curvature of said log.

6. The method of claim 1, further including the step of adjusting the outermost saw blade of the sawing section so that it slides along the reduced flat surface of said log, whereby the reduced flat surface is given the same texture as a a sawn surface.

7. The method of claim 1 wherein the available plank width is calculated by the formula:

$$h_1 = 2(x_2 + s_1 + t_1)(x_1 - s_1 - t_1)$$

where $h_1$ is the available plank width on one side of said log, $x_1$ is the distance from the center line of said log to the edge of said log on that side, $s_1$ is the distance from said center line to the inside edge of the outermost saw blade on that side, $t_1$ is the thickness of the plank being formed by said saw blade on that side of said log, and $x_2$ is the distance from the center line of said log to the opposite side of said log.

8. The method of claim 1 wherein the available plank thickness on one side of said log is calculated as a function of the distance from the center line of said log to the edge of the log on that side and said minimum acceptable width, and wherein said method further includes the steps of comparing said available plank thickness to a proposed plank thickness corresponding to the thickness of a plank that would be formed by the outermost saw blade on that side of said log with said saw blade in its current position, generating an error indication that is proportional to the result of said comparison, determining if said error indication is positive and thus indicative of said logging having a diameter from which a plank can be produced that is larger than the plank that would be produced by said saw blade in its current position, determining if the available plank length is larger than said minimum acceptable plank length, and moving the reducing disk on that side of said log away from said center line by a predetermined distance when said error indication is positive and said available plank length is larger than said minimum acceptable plank length.

9. The method of claim 8, further including the steps of calculating the derivative of said error indication and inhibiting the movement of said reducing disk unless the derivative of said errors indication is positive.

10. A timber processing system, comprising:

a flat reducing section having a pair of reducing disks on opposite sides of a center line, said reducing section further including respective positioning devices for moving said reducing disks toward and away from said center line;

a sawing section positioned on said center line downstream from said reducing section, said sawing section having at least two laterally adjustable saw blades;

a conveyor moving logs longitudinally along said center line through said reducing section and said sawing section;

a profile measuring device for determining the contour of said logs relative to a reference line before being processed by said reducing section;

calculator means programmed with a minimum acceptable plank thickness, width and length, said calculator means receiving the output of said profile measuring device and determining from the contour of said logs the available plank thickness, width and length corresponding to the thickness, width and length of the portions of said log which would be removed by said reducing disks in their current positions, said calculator means further comparing said available plank thickness, width and length to said minimum acceptable plank thickness, width and length, respectively, and generating an actuating signal for the positioning device of at least one of said reducing disks to move said disk away from said center line by at least said minimum acceptable thickness in the event that said available plank thickness, width and length are all greater than said minimum acceptable plank thickness, width and length, respectively;

memory means for receiving and storing said signal; and trigger means actuatable by said logs one by one for feeding said signal to said positioning device.

11. The timber processing system of claim 10 wherein said calculator means determines the available plank width by the formula:

$$h_1=2(x_2+s_1+t_1)(x_1-s_1-t_1)$$

where $h_1$ is the available plank width on one side of said log, $x_1$ is the distance from the center line of said log to the edge of said log on that side, $s_1$ is the distance from said center line to the inside edge of the outermost saw blade on that side, $t_1$ is the thickness of the plank being formed by said saw blade on that side of said log, and $x_2$ is the distance from the center line of said log to the opposite side of said log.

12. The timber processing system of claim 10, further comprising means for adjusting the lateral position of said saw blades in dependence of actuating signals received from said calculating means.

13. The timber processing system of claim 10, further including a laterally displaceable guide member on each side of said log positioned between said reducing section and said sawing section, said guide members being displaceable in the same direction and by the same distance as the associated reducing disk.

14. The timber processing system of claim 13, further including positioning means for said guide members other than said positioning devices for said reducing disks and means for delaying the movement of said guide means relative to the movement of the associated reducing disk by a predetermined period of time related to the feed speed of said conveyor.

15. The timber processing system of claim 10, further including means for measuring the curvature of said log and control means for simultaneously actuating the positioning devices for said reducing disks in accordance with the curvature of the log.

16. The timber processing system of claim 10 wherein said calculator means comprise:

first means for calculating the available plank thickness on one side of said log as a function of said minimum acceptable width and the distance from the center line of said log to the edge of the log on that side;

first comparator means for comparing said available plank thickness to a proposed plank thickness corresponding to the thickness of a plank that would be formed by the outermost saw blade on that said of said log if said saw blade remained in its current position, said first comparator means generating an error signal proportional to the result of said comparison;

second comparator means for comparing said available plank length to said minimum acceptable plank length; and actuating means for moving the reducing disk on that side of said log away from said center line by a predetermined distance in response to said error indication being positive and said available plank length being larger than said minimum acceptable plank length.

17. The timber processing system of claim 16, further including means for calculating the derivative of said error signal with respect to time and inhibiting means for preventing the movement of said reducing disk unless the derivative of said error signal is positive.

18. A timber processing system, comprising:

a flat reducing section having a pair of reducing disks on opposite sides of a center line, said reducing section further including respective positioning devices for moving said reducing disks toward and away from said center line;

a sawing section positioned on said center line downstream from said reducing section, said sawing section having at least two laterally adjusted saw blades;

a conveyor moving logs longitudinally along said center line through said reducing section and said sawing section;

a profile-measuring device for determining the contour of said logs relative to a reference line before being processed by said reducing section;

a laterally displaceable guide member on each side of said log positioned between said reducing section and said sawing section, said guide members being displaceable in the same direction and by the same distance as the associated reducing disk;

positioning means other than said positioning devices for said reducing disks; and means for delaying the movement of said guide means relative to the movement of the associated reducing disk by a predetermined period of time related to the feed speed of said conveyor.

* * * * *